US008613127B2

(12) United States Patent
Kaltenrieder

(10) Patent No.: US 8,613,127 B2
(45) Date of Patent: Dec. 24, 2013

(54) DEVICE FOR SECURING A STRAP OR BRACELET

(75) Inventor: Cedric Kaltenrieder, Bienne (CH)

(73) Assignee: The Swatch Group Management Services AG, Bienne (CH)

( * ) Notice: Subject to any disclaimer, the term of this patent is extended or adjusted under 35 U.S.C. 154(b) by 230 days.

(21) Appl. No.: 12/948,328

(22) Filed: Nov. 17, 2010

(65) Prior Publication Data

US 2011/0113594 A1 May 19, 2011

(30) Foreign Application Priority Data

Nov. 18, 2009 (EP) ..... 09176352

(51) Int. Cl.
*A44C 5/14* (2006.01)

(52) U.S. Cl.
USPC ..... 24/265 WS; 24/265 R; 368/282

(58) Field of Classification Search
USPC ..... 24/265 WS, 265 B, 265 R; 63/22; 224/167, 180; 368/282
See application file for complete search history.

(56) References Cited

U.S. PATENT DOCUMENTS

| | | | | | |
|---|---|---|---|---|---|
| 2,870,511 | A | * | 1/1959 | Sand | 24/265 B |
| 2,901,806 | A | * | 9/1959 | Henshel | 24/265 R |
| 2,932,074 | A | * | 4/1960 | Resnick | 24/265 B |
| 3,712,173 | A | * | 1/1973 | Savioli et al. | 89/33.14 |
| 3,824,783 | A | * | 7/1974 | Nadeau | 368/282 |
| 4,212,434 | A | * | 7/1980 | Walker | 242/599.1 |
| 4,564,308 | A | * | 1/1986 | Ikegami et al. | 403/166 |
| 5,483,505 | A | * | 1/1996 | Cartier | 368/282 |
| 7,507,018 | B2 | * | 3/2009 | Hozumi et al. | 368/282 |

FOREIGN PATENT DOCUMENTS

| | | | |
|---|---|---|---|
| CH | 239 046 | A | 12/1945 |
| CH | 327 838 | A | 3/1958 |
| CH | 697 152 | A5 | 5/2008 |
| DE | 91 06 543 | U1 | 8/1991 |
| FR | 2 721 118 | A1 | 12/1995 |

* cited by examiner

*Primary Examiner* — Robert J Sandy
*Assistant Examiner* — Rowland D Do
(74) *Attorney, Agent, or Firm* — Sughrue Mion, PLLC

(57) ABSTRACT

A timepiece movement including a tourbillon that has a rotating carriage bearing a sprung balance and an escapement. The carriage includes a top pivot and a bottom pivot, respectively carried by a top bridge and a bottom bridge of the carriage. The carriage pivots between a bottom plate of the timepiece movement and a bridge of the movement. The timepiece movement includes a stop member, arranged for limiting the axial shake of the carriage.

11 Claims, 2 Drawing Sheets

DEVICE FOR SECURING A STRAP OR BRACELET

This application claims priority from European Patent Application No. 09176352.4 filed 18.11.2009, the entire disclosure of which is incorporated herein by reference.

FIELD OF THE INVENTION

The invention relates to the field of watchmaking or jewellery. It concerns more specifically a device for securing a strap or bracelet to an object, in particular to a watchcase.

BACKGROUND OF THE INVENTION

Generally, straps or bracelets, made of leather or metal are fixed to the horns of a watchcase, via a bar formed of a tube, in which are mounted two pistons that can move in translation, and an elastic member arranged between said pistons which tends to drive them towards the exterior of the tube. Said bar is mounted in a housing provided for this purpose at one end of the strap or bracelet, and the pistons are engaged in blind bores made facing each other in the horns of the case.

To remove a strap or bracelet secured to a case in this manner, a tool is required, designed to push the pistons back into the tube, against the force exerted by the elastic member, and thereby remove the pistons from the bores. The person wearing the watch does not permanently have such a tool available and, further, the use thereof can be inconvenient. This is why straps and bracelets provided with this type of securing device are generally permanently attached to the watch.

There also exist securing devices that allow the strap or bracelet to be removed from the case without using a tool. Such devices usually include a bar, of the type described above, on which a member for actuating the pistons is mounted, passing through the tube. Said actuating member is, for example, a radial finger integral with one of the pistons, as described in CH Patent No 327838. The finger is slidably mounted through an axial slot made in the tube and the movement thereof along the slot pushes one of the pistons back inside the tube. In CH Patent No. 697152, the actuating member is a push-button movably mounted radially through the tube. The pistons are provided with support surfaces located opposite each other when the two pistons are head to tail inside the tube. The push-button includes two arms that cooperate with said support surfaces so as to draw the pistons towards the inside of the tube when said push-button is pushed in.

The securing devices thus described are generally used for interchangeable straps or bracelets, which can be replaced as the user desires. They are not, however, free of drawbacks. It will be noted, in particular, that they require major structural alterations to the bar, such as, for example, making an opening in the tube, or transforming the pistons. These changes lead to significant increases in manufacturing costs. These securing devices further include a projecting element, namely the actuating member, which may become caught on or injure the person wearing the watch.

SUMMARY OF THE INVENTION

The present invention overcomes these drawbacks by proposing a device for securing a strap or bracelet that includes a standard bar and at least one non-projecting actuating member. More precisely, the invention concerns a device for securing a strap or bracelet to an object, particularly a watchcase, including a bar formed of a tube in which there are housed at least a first piston that is mobile in translation and an elastic member that tends to drive the piston towards the exterior of the tube. According to the invention, the securing device further includes a mechanism for actuating the bar, including a first bent arm, slidably mounted axially relative to the bar between a retracted position A and a deployed position B, and one end of which cooperates with the first piston to push said piston towards the interior of the tube, and a first control member cooperating with the first arm to move it from retracted position A to deployed position B and vice versa.

Owing to the bent shape thereof the sliding arm can actuate the piston from the exterior of the bar, via one of the ends thereof, without any structural modification of the bar.

In an advantageous embodiment of the invention, the first control member is formed of a lever pivotally mounted above the first arm, between a turned down position C, and an upright position D, respectively corresponding to the deployed position B and withdrawn position A of the first arm.

Owing to this feature of the control member, the latter does not project relative to the rest of the device when the piston is in deployed position B, in particular when the strap or bracelet is secured to a watchcase.

In one possible embodiment, the strap or bracelet includes a housing in which the bar is mounted, and the actuating mechanism is fixed to the strap or bracelet in proximity to the bar. In another possible embodiment, the actuating mechanism is integral with the bar and the strap or bracelet includes a housing containing said mechanism, the first control member being mounted so as to emerge from the housing.

BRIEF DESCRIPTION OF THE DRAWINGS

Other features and advantages of the present invention will appear more clearly from the following detailed description of an example embodiment of a device for securing a strap or bracelet according to the invention, this example being given purely by way of non-limiting illustration, with reference to the annexed drawings, in which.

DETAILED DESCRIPTION OF THE PREFERRED EMBODIMENTS

Figure 1:
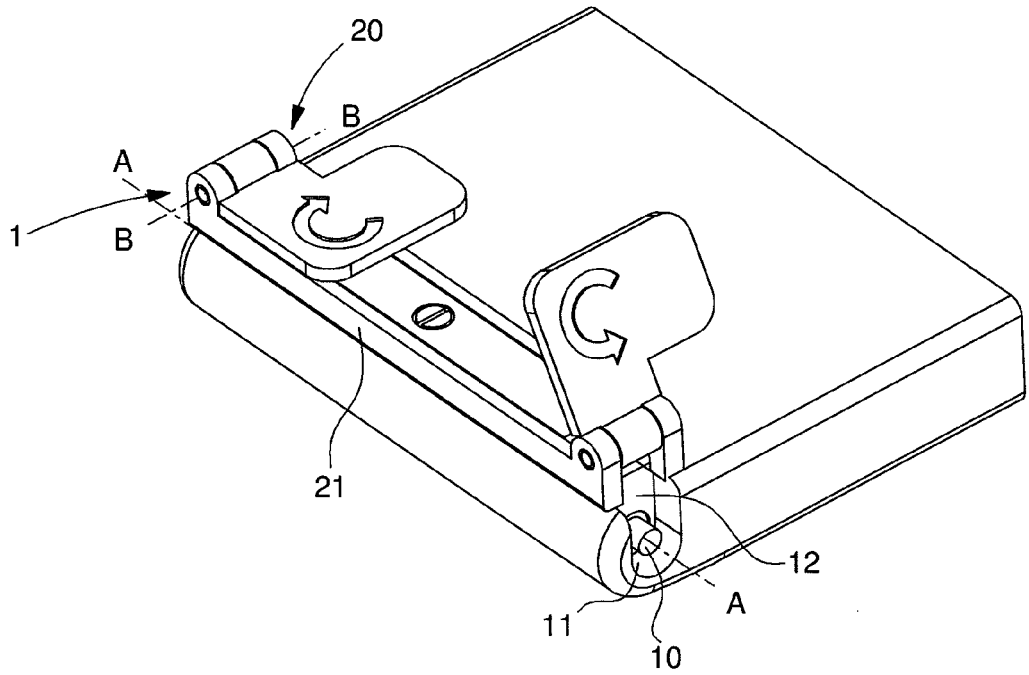
FIG. 1 is a perspective view of a securing device according to the invention integrated in a leather strap.
Figure 2:
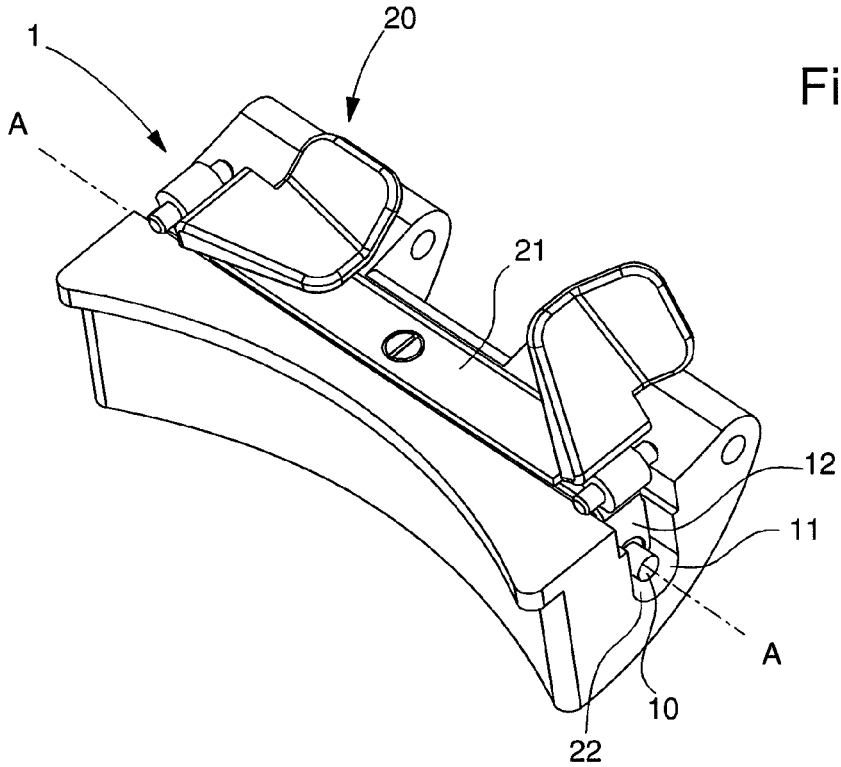
FIG. 2 shows the same device mounted on a link of a metal bracelet.

The securing device shown in FIGS. 1 and 2 and referenced as a whole as 1, includes, in a conventional manner, a bar 10 of axis AA, mounted in a housing 11 provided for this purpose in a leather, metal or plastic strap or bracelet. In FIG. 1, said housing 11 is formed by fold in a leather strap at one end thereof, whereas in FIG. 2, it is formed of a bore passing through the link for attaching a metal bracelet. In both cases, housing 11 is provided, at the ends thereof, with two axial recesses 12 made in the inner face of the strap or bracelet, i.e. the face that will come into contact with the wrist. The function of these recesses 12 will be described below. Bar 10 includes, in a standard manner, a tube 13, not visible in FIGS. 1 and 2, in which two pistons 14 with a collar are slidably mounted. An elastic member, such as a helical spring, is conventionally inserted between the two pistons 14, to drive them towards the exterior of tube 13.

According to the invention, securing device 1 further includes a mechanism 20 for actuating bar 10, mounted on the inner face of the strap or bracelet, above housing 11. It includes a support element 21, secured to the strap or bracelet at the location described above. Support element 21 is, for example, glued or screwed onto the leather strap. In the metal bracelet, it can be screwed, welded or snap fitted in a cavity 22 provided for such purpose. In the embodiment shown, support element 21 is formed overall of a flat parallelepiped. In a variant, it could be formed of two U-shaped bars mounted opposite and parallel to each other.

Figure 3:
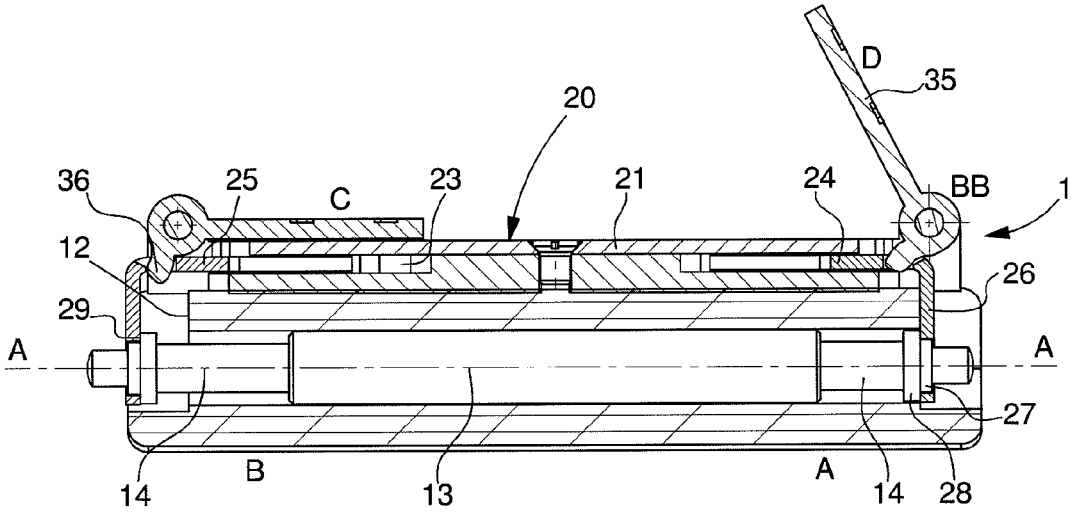
FIG. 3 illustrates a first longitudinal cross-section of the securing device according to the invention.
Figure 4:
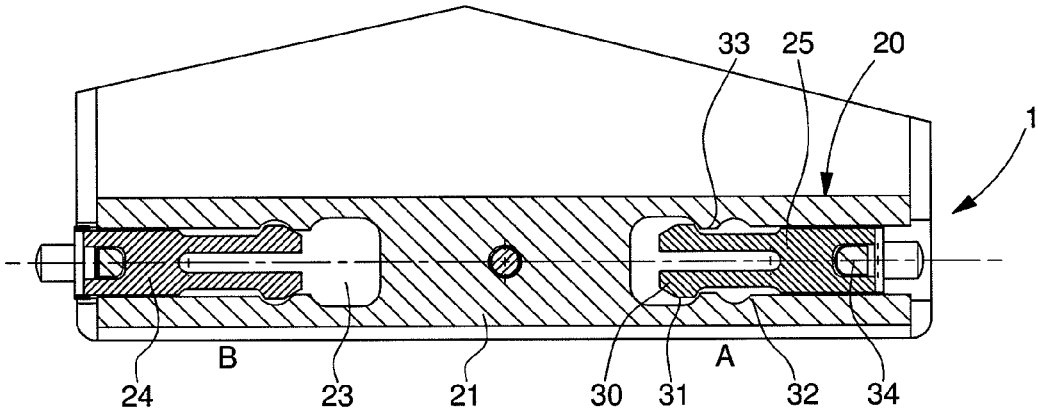
FIG. 4 is a second longitudinal cross-section, perpendicular to the first, of said device.

Actuating member 20 for bar 10 is shown in FIGS. 3 and 4 in two longitudinal cross-sections, respectively perpendicular to support element 21, passing through axis AA of bar 10, and in the plane of said element. Support element 21 includes two longitudinal slots 23, open on both lateral sides of the parallelepiped, in which two arms 24 are slidably mounted. The latter are formed overall of two bent L-shaped strips, whose longest strands 25 are slidably mounted inside slots 23, between a retracted position A and a deployed position B, and whose shortest strands 26 cooperate with pistons 14. For this purpose, the short strands 26 are pierced with a hole 27 at the end thereof, in which the ends of pistons 14 are freely engaged. The latter are also provided with a collar 28 forming a shoulder 29 against which the short strands 26 rest. In deployed position B, short strands 26 are flush with the edges of the strap or bracelet, and the end of pistons 14 projects relative to housing 11, whereas in retracted position A, they are positioned at the bottom of recesses 12, and pistons 14 are entirely engaged in housing 11.

The long strands 25 are slit at the ends thereof, each thus separating into two fingers 30 forming an elastic U-shape in the plane of said strands 25. Fingers 30 are provided with a protruding portion 31, extending outwards in the plane of strands 25. Slots 23 are provided with a first constricted portion 32 for guiding arms 24 and for cooperating with protruding portions 31 to prevent arms 24 from exiting cavities 23 in deployed position B. They further include a second constricted portion 33, located in proximity to the bottom thereof, for cooperating with protruding portions 31 to lock arms 24 in retracted position A. Long strands 25 are further provided with an aperture 34, located in proximity to the bend in arms 24, the function of which will become clear below.

It will be noted that, if support element is formed of two, parallel-mounted, U-shaped bars, arms 24 are slidably mounted inside said bars. Like slots 23, the bars are then provided with constricted portions 32 and 33 for locking arms 24.

Actuating mechanism 20 for bar 10 further includes two control members 35 for arms 24, pivotally mounted on support element 21, between a turned down position C and an upright position D, above arms 24. Said control members 35 are overall formed of a lever, pivotally mounted about an axis BB perpendicular to axis AA and approximately parallel to the plane of support element 21. Said lever is bent so as to form an actuating finger 36 oriented at right angles or a slightly obtuse angle, which is engaged in aperture 34 in long strands 25.

The securing device thus described operates as follows. Control members 35 are normally in turned down position C on support element 21. In this position, fingers 36 engaged in apertures 34 push arms 24 towards the exterior of cavities 23. Arms 24 are then locked in deployed position B, on one side by actuating fingers 36 and on the other side by constricted portion 32. In this deployed position, pistons 14 of bar 10 are driven towards the exterior of tube 13 by the elastic member inserted between them. The end thereof projects relative to the strap or bracelet. When control members 35 are tilted into upright position D, actuating fingers 36 engaged in apertures 34 push arms 24 towards the interior of cavities 23. Arms 24 are then locked in retracted position A, by constricted portion 33. In this retracted position, short strands 26, resting on shoulders 29, keep pistons 14 inside housing 11, against the action of the elastic member inserted between pistons 14. In this upright position D, the strap or bracelet can be engaged between the horns of a watchcase, provided with blind bores. To secure the strap or bracelet to the case, control members 35 need only be folded down onto casing 31 in position C. The end of pistons 14 engages in the bores and the strap or bracelet is secured to the case. To remove the strap or bracelet from the case, the user need only place control members 35 back upright in position D. Pistons 14 are then released from the blind bores and the strap or bracelet is released.

Thus a device 1 for securing a strap or bracelet has been described, provided with a standard type bar and allowing said strap or bracelet to be mounted on or dismantled from a case, without using a tool. Of course, the device for securing a strap or bracelet according to the invention is not limited to the embodiment that has just been described and various simple alterations and variants can be envisaged by those skilled in the art without departing from the scope of the invention as defined by the annexed claims.

It will be noted, in particular, that the securing device 1 described above exhibits symmetry relative to a plane perpendicular to axis AA of bar 10. It is thus provided with two sliding pistons 14, actuated by two arms 24, which are controlled by two control members 35. However, securing device 1 could include a single sliding piston 14, the other piston 14 then being fixedly mounted. In that case, assembly of the strap or bracelet on the case would have to start with the introduction of the fixed piston in a bore in the horn, with the mobile piston in the retracted position. Once the strap or bracelet is housed between the two horns and the fixed piston is engaged in its bore, the mobile piston would have to be actuated in the deployed position.

Moreover, in the embodiment shown, actuating mechanism 20 for bar 10 is separate from bar 10, and directly mounted on the strap or bracelet. In a variant, actuating device 20 for bar 10 could be integral therewith, with the support element being welded or secured via flanges to the tube. The bar-actuating mechanism assembly would then be mounted in a housing 11 provided for that purpose, from which only control members 35 would emerge.

What is claimed is:

1. A device for securing a strap or a bracelet to a watchcase, said device including a bar formed of a tube in which are housed at least:

a first piston, which is mobile in translation, and an elastic member that tends to drive said piston towards the exterior of said tube, wherein said device further includes a mechanism for actuating said bar including:

a first arm slidably mounted axially relative to said bar between a retracted position A and a deployed position B, and one end of said first arm cooperates with said first piston to push the latter towards the interior of said tube in a stable position when said first arm is in said retracted position A, and a first control member pivotable with said first arm so as to move said arm from the retracted position A to the deployed position B and vice versa upon pivotal movement of the first control member.

2. The securing device according to claim 1, wherein said first control member is formed of a lever pivotally mounted above said first arm, between a folded down position C, corresponding to the deployed position B of said first arm and an upright position D, corresponding the retracted position A of said first arm.

3. The securing device according to claim 2, wherein said first control member is formed of a bent lever forming an actuating finger, and wherein said first arm includes an aperture in which said actuating finger is engaged.

4. The securing device according to claim 1, wherein said actuating mechanism for said bar includes a support element on which the first arm is slidably mounted and said first control member is moveably mounted.

5. The securing device according to claim 4, wherein said first bent arm is formed of an L-shaped strip, including a long strand slidably mounted on said support element and a short strand cooperating with said first piston.

6. The securing device according to claim 5 wherein said support element is formed overall of a flat parallelepiped provided with a slot in which said long strand is slidably mounted.

7. The securing device according to claim 5, wherein said support element is formed overall of two U-shaped bars mounted opposite and parallel to each other, in which said long strand is slidably mounted.

8. The securing device according to claim 5, wherein said short strand is pierced with a hole in which the end of said first piston is freely engaged, and wherein said first piston includes a collar forming a shoulder against which said short strand rests.

9. The securing device according to claim 1, wherein it further includes a second piston that is mobile in translation inside said tube, opposite said first piston, a second bent arm, slidably mounted axially relative to said bar between said retracted position A and said deployed position B, and one end of which cooperates with said second piston to push the latter towards the interior of said tube, and a second control member cooperating with said second arm to move said arm from the retracted position A to the deployed position B and vice versa.

10. A device for securing a strap or a bracelet to a watchcase, said device including a bar formed of a tube in which are housed at least:

a first piston, which is mobile in translation, and an elastic member that tends to drive said piston towards the exterior of said tube, wherein said device further includes a mechanism for actuating said bar including:

a first arm slidably mounted axially relative to said bar between a retracted position A and a deployed position B, and one end of said first arm cooperates with said first piston to push the latter towards the interior of said tube in a stable position when said first arm is in said retracted position A, and a first control member pivotable cooperating with said first arm so as to move said arm from the retracted position A to the deployed position B and vice versa upon pivotal movement of the first control member, wherein said actuating mechanism for said bar includes a support element on which the first arm is slidably mounted and said first control member is moveably mounted, wherein said strap or bracelet includes a housing in which said bar is mounted, and wherein said support element is fixed to said strap or bracelet in proximity to said bar, such that said first bent arm cooperates with said first piston.

11. A device for securing a strap or a bracelet to a watchcase, said device including a bar formed of a tube in which are housed at least:

a first piston, which is mobile in translation, and an elastic member that tends to drive said piston towards the exterior of said tube, wherein said device further includes a mechanism for actuating said bar including:

a first arm slidably mounted axially relative to said bar between a retracted position A and a deployed position B, and one end of said first arm cooperates with said first piston to push the latter towards the interior of said tube in a stable position when said first arm is in said retracted position A, and a first control member pivotable cooperating with said first arm so as to move said arm from the retracted position A to the deployed position B and vice versa upon pivotable movement of the first control member, wherein said actuating mechanism for said bar includes a support element on which the first arm is slidably mounted and said first control member is moveably mounted, wherein said support element is integral with said bar, and wherein said strap or bracelet includes a housing in which the bar-actuating mechanism assembly is housed, said first control member being mounted so as to emerge from said housing.

* * * * *